US006618036B1

(12) United States Patent
Tanaka

(10) Patent No.: US 6,618,036 B1
(45) Date of Patent: Sep. 9, 2003

(54) JOY STICK

(75) Inventor: Atsushi Tanaka, Chofu (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 09/677,148

(22) Filed: Oct. 2, 2000

(30) Foreign Application Priority Data

Dec. 20, 1999 (JP) ..... 11-361881

(51) Int. Cl.[7] ..... G09G 5/08
(52) U.S. Cl. ..... 345/161; 74/47 XY
(58) Field of Search ..... 345/161, 156, 345/158; 74/471 XY

(56) References Cited

U.S. PATENT DOCUMENTS 4,459,440 A * 7/1984 Wiczer ..... 200/6 A
4,558,609 A * 12/1985 Kim ..... 74/471 XY
4,587,510 A * 5/1986 Kim ..... 338/128
5,229,742 A * 7/1993 Miyamoto et al. ..... 338/128
5,422,448 A * 6/1995 Nakano et al. ..... 200/11 DA
5,691,898 A * 11/1997 Rosenberg et al. ..... 700/85
6,181,327 B1 * 1/2001 Lin et al. ..... 345/161
6,259,433 B1 * 7/2001 Meyers ..... 345/161

* cited by examiner

*Primary Examiner*—Steven Saras
*Assistant Examiner*—Leland Jorgensen
(74) *Attorney, Agent, or Firm*—Fattibene & Fattibene; Paul A. Fattibene; Arthur T. Fattibene

(57) ABSTRACT

A joy stick which is simply constituted using a decreased number of parts. The joy stick has two swing arms 23 and 24 intersecting at right angles and are supported by a shaft so as to be operated by the swinging operation of a lever 27 and to transmit the rotational displacement to rotary encoders, and a contact switching means 33 that is switched by the depressing operation of the lever 27 in a casing 22, wherein an upper end of a spring 35 is brought into contact with the outer circumference of the lever 27 to maintain the attitude of the lever 27, a support member 31 is provided for limiting the upward displacement of the lever 27, plural protrusions 30, 30, —are formed near the lower end along the outer circumference of the lever 27 to protrude outward and to support the lower end of the spring 35, the contact switching means 33 is provided on a base plate 34, and the base plate 34 is used as the bottom plate of the casing 22.

3 Claims, 4 Drawing Sheets

JOY STICK

BACKGROUND OF THE INVENTION

1. Field of the Invention

The present invention relates to a joy stick. More particularly, the invention relates to a joy stick in which two swing arms intersecting at right angles are supported by a shaft to transmit the rotational displacement produced by the swinging operation of a lever, and in which a contact switching means is disposed for executing the switching operation upon depressing the lever.

2. Prior Art

A conventional joy stick of this kind will be described with refernce to FIG. 4 In FIG. 4, refernce numeral 1 denotes a joy stick. The joy stick 1 has a box-like casing 2 in wihch two arms 3 and 4 intersecting at right angles up and down are swigable suported by a shaft, and lever 5 passes through the arms 3 and 4 to swing and to slide in the axial direction. Further, a swing plate 6 of nearly a disk-like shape is secured to the lower end of the lever 5, and a protruded surface 6*a* is formed in nearly a semispherical shape to protrude beyond the lower surface at the center of the swing plate 6.

A guide member 7 is provided under the swing plate 6 to guide the swing plate 6 in the up-and-down direction, and a spring 8 is arranged under the guide member 7 to urge the guide member 7 upward. Under the spring 8 is provided a flexible member 9 of nearly a disk-like shape being made of a flexible material, and a protruded portion 9*a* is formed at the center of the flexible member 9 to protrude up and down. The upper end of the protruded portion 9*a* penetrates through the center of the guide member 7 and extends near to the lower end of the swing plate 6. Under the protruded portion 9*a* is provided a moving contact member made of a flexible material in a dome shape. Under the moving contact member 10 are provided a fixed contact member 11 of an Ω-shape as viewed on a plane which is in contact with the moving contact member 10 at all times, and a fixed contact member 12 of a circular shape as viewed on a plane which is separated away form the moving contact member 10.

A bottom plate 13 of the casing of the joy stick 1 is disposed under the fixed contact members 11 and 12, a recessed portion 13*a* is formed in the upper part of the bottom plate 13 of the casing, the recessed portion 13*a* having a diameter larger than the moving contact member 10, and the moving contact member 10 and the fixed contact members 11, 12 are secured to the bottom plate 13 of the casing in which the recessed portion 13*a* is formed.

When the lever 5 is depressed in the direction of an arrow A, the swing plate 6 secured to the lower end of the lever 5 pushes down the protruded portion 9*a* formed on the flexible member 9. As the flexible member 9 deflects, the protruded portion 9*a* depresses the moving contact member 10, whereby the moving contact member 10 comes in contact with the fixed contact member 12, so that the circuit between the moving contact member 10 and the fixed contact member 12 is closed.

When the lever 5 is no longer depressed in the direction of the arrow A, the lever 5 automatically returns upward due to the restoring forces of the moving contact member 10, flexible member 9 and spring 8, and the circuit between the moving contact member 10 and the fixed contact member is opened.

When the lever 5 is moved in, for example, the direction of an arrow B, the arm 3 swings, and the displacement in the rotational angle caused by the swing is transmitted to a rotary encoder 14 coupled to an end of the arm 3. In FIG. 4, reference numeral 14A denotes the rotary encoder coupled to the arm 4.

In the above-mentioned conventional joy stick, the swing plate is secured to the lower end of the lever, the guide member is provided under the swing plate to guide the swing plate in the up-and-down direction, and the bottom plate of the casing is disposed under the casing of the joy stick. Therefore, an increased number of parts are required, and the constitution is complex.

Thus, there arouses a technical problem that must be solved for decreasing the number of parts of the joy stick as much as possible, for simplifying the structure and for decreasing the cost. The object of the present invention is to solve this problem.

SUMMARY OF THE INVENTION

The present invention was proposed in order to achieve the above-mentioned object, and provides a joy stick in which two swing arms intersecting at right angles are supported by a shaft so as to be operated by the swinging operation of a lever and to transmit the rotational displacement to rotary encoders, and a contact switching means that is switched by the depressing operation of the lever is provided in a casing, wherein an upper end of a spring is brought into contact with the outer circumference of the lever to maintain the attitude of the lever, a support member is provided for limiting the upward displacement of the lever, plural protrusions are formed near the lower end along the outer circumference of the lever to protrude outward and to support the lower end of the spring, the contact switching means is provided on a base plate, and the base plate is used as the bottom plate of the casing.

DESCRIPTION OF THE PREFERRED EMBODIMENT

Figure 1:
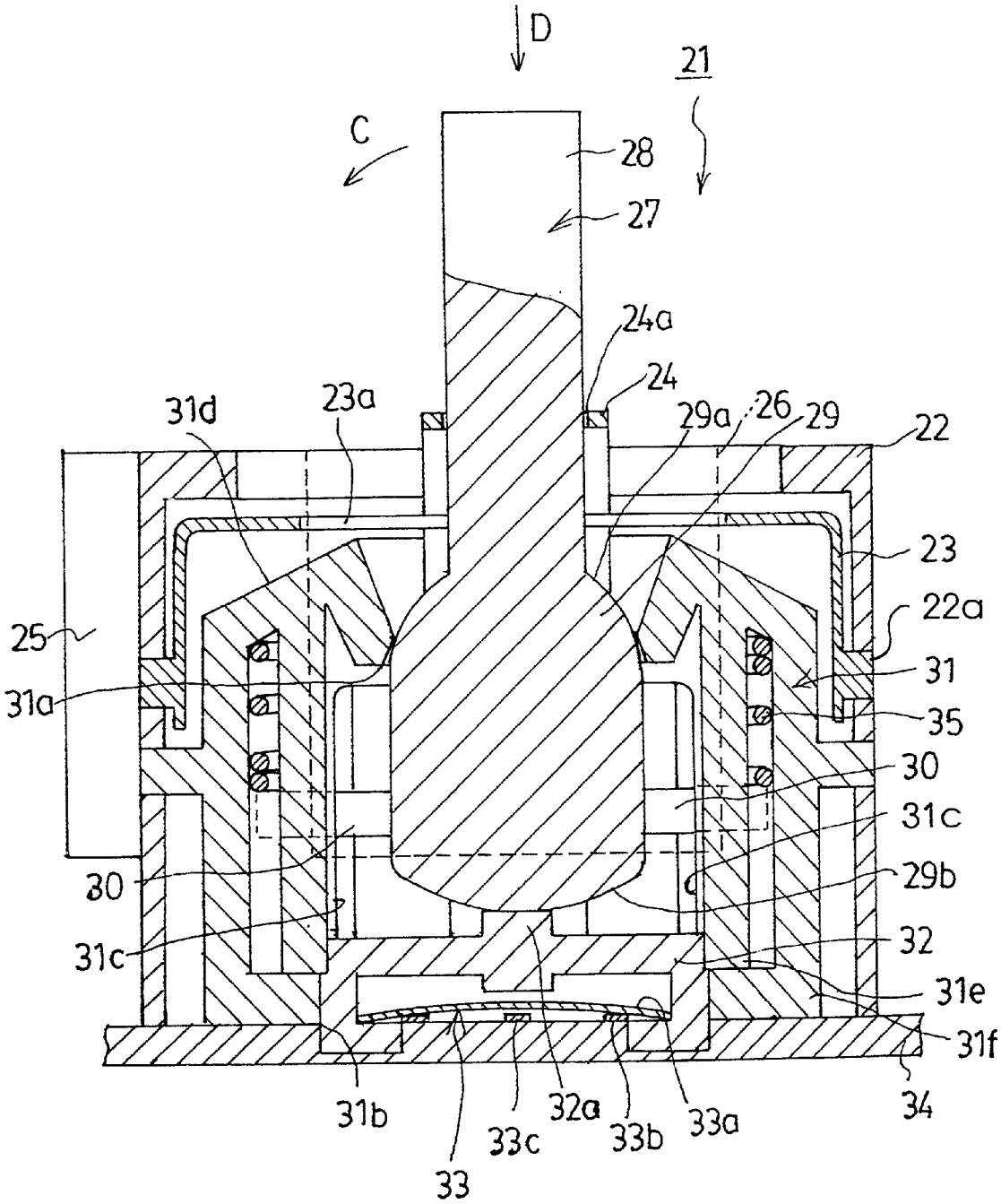
FIG. 1 is a partly cut-away vertical sectional view of a joy stick according to an embodiment of the present invention.
Figure 2:
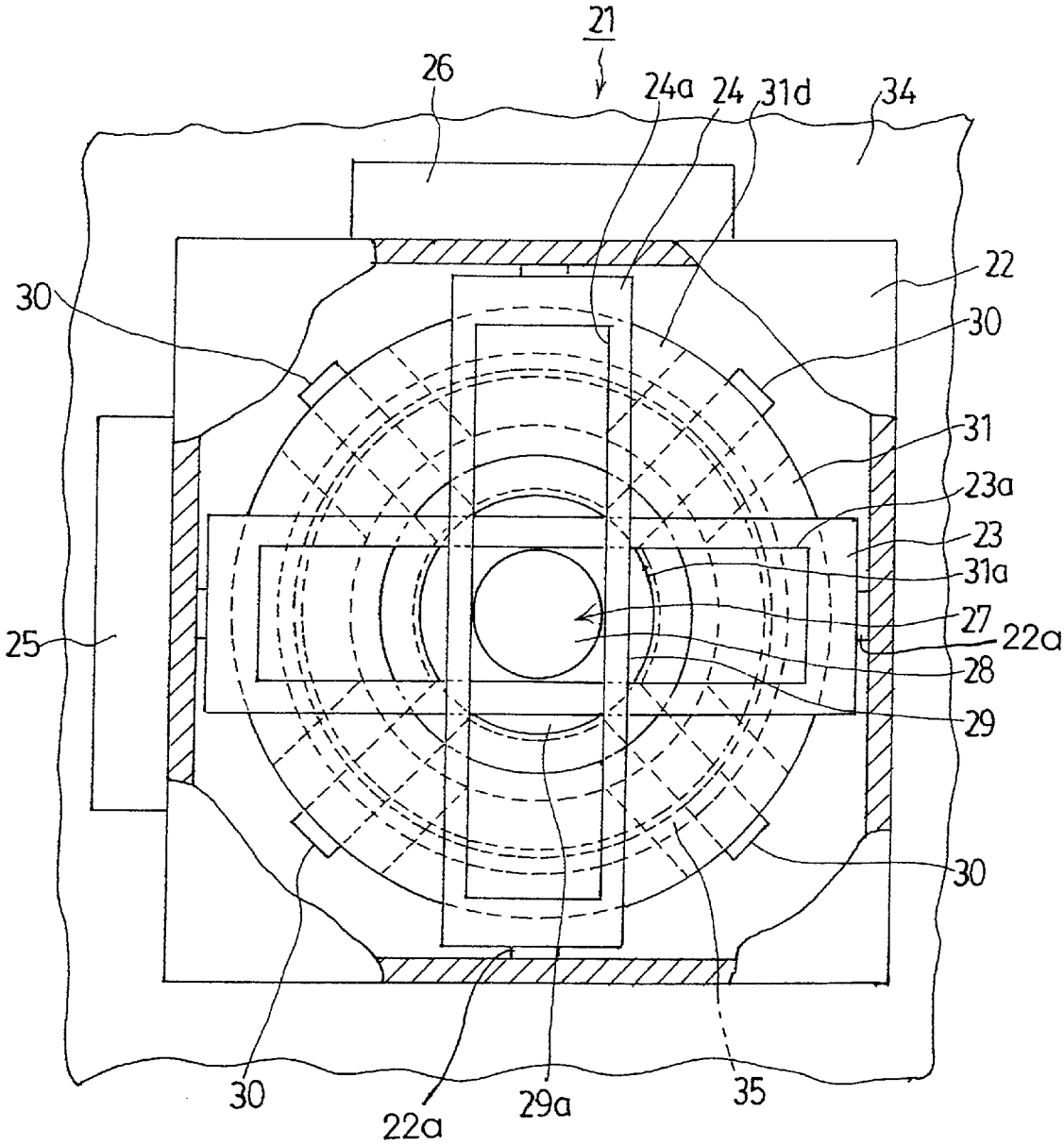
FIG. 2 is a partly cut-away plan view of the joy stick according to the embodiment of the present invention.

An embodiment of the invention will now be described in detail with reference to FIGS. 1 to 3. In FIGS. 1 and 2, reference numeral 21 denotes a joy stick which is contained in a box-like casing 22 of which the lower surface is opened. Two swing arms 23 and 24 intersecting at right angles are supporting by a shaft 22*a* in the casing 22 to swing therein. The swing arms 23 and 24 are provided being separated up and down, and one end of the swing arm 23 is connected to a rotary encoder 25 and one end of the swing arm 24 is connected to a rotary encoder 26.

Elongated holes 23*a* and 24*a* extending in the axial directions are perforated in the upper central portions of the swing arms 23 and 24. A lever 27 of nearly a cylindrical shape is provided to slide penetrating through the elongated holes 23*a* and 24*a*. The lever 27 includes a small-diameter portion 28 which is an upper half portion and a large-diameter portion 29 which is a lower half portion. A spherical portion 29*a* is formed at the upper end of the large-diameter portion 29 and a spherical portion 29*b* is formed at the lower end thereof. Further, protrusions 30, 30, - - - are formed in a plural number near the lower end along the outer circumference of the large-diameter portion 29 to protrude outward.

A support member 31 of roughly a double cylindrical shape having openings 31*a* and 31*b* at both ends is provided surrounding the lever 27. Openings 31*c*, 31*c*, - - - for passing through the protrusions 30, 30, - - - are perforated in the side portion of the support member 31, the upper portion 31*d* of the support member 31 is formed like a mountain with its central portion defining a funnel shape, and the opening 31*a* is perforated in the center of the funnel-shaped portion. The lever 27 penetrates through the opening portion 31*a*. The spherical portion 29*a* formed on the large-diameter portion 29 of the lever 27 comes in contact with the upper portion 31*d* of the support member 31, so that the lever 27 is limited from being displaced upward.

A flexible member 32 having a nearly inversely recessed shape in cross section is disposed under the lever 27. A protruded portion 32*a* protruding up and down is formed on the flexible member 32 at the central portion thereof. Under the protruded portion 32*a* are provided a moving contact member 33*a* having a dome-like shape and is made of a flexible material, a fixed contact member 33*b* having nearly an Q-shape as viewed on a plane under the moving contact member 33*a* and being contacted to the moving contact member 33*a* at all times, and a fixed contact member 33*c* arranged at the center of the fixed contact member 33*b* and is separated away from the moving contact member 33*a*, thereby to constitute a contact switching means 33. The fixed contact members 33*b* and 33*c* are secured to a base plate 34 provided in the lower opened portion of the casing 22, and the base plate 34 also works as the bottom plate of the casing 22.

A spring 35 is arranged between an outer cylinder 31*e* and an inner cylinder 31*f* of the support member 31, the upper end of the spring 35 is brought into contact with the upper portion 31*d* of the support member 31, and the lower end thereof is placed on the protrusions 30, 30, - - - provided for the large-diameter portion 29 of the lever 27. The spring 35 is fitter thereto from the lower side by deforming the inner cylinder 31*f*. However, the fitting method is in no way limited thereto only.

Therefore, the lever 27 is urged downward by the spring 35 and is supported by the flexible member 32. The flexible member 32 has an elasticity stronger than that of the spring 35 so that the flexible member 32 will not be deformed when the lever 27 is not operated and that the protruded portion 32*a* of the flexible member 32 will not depress the moving contact member 33*a*.

Figure 3:
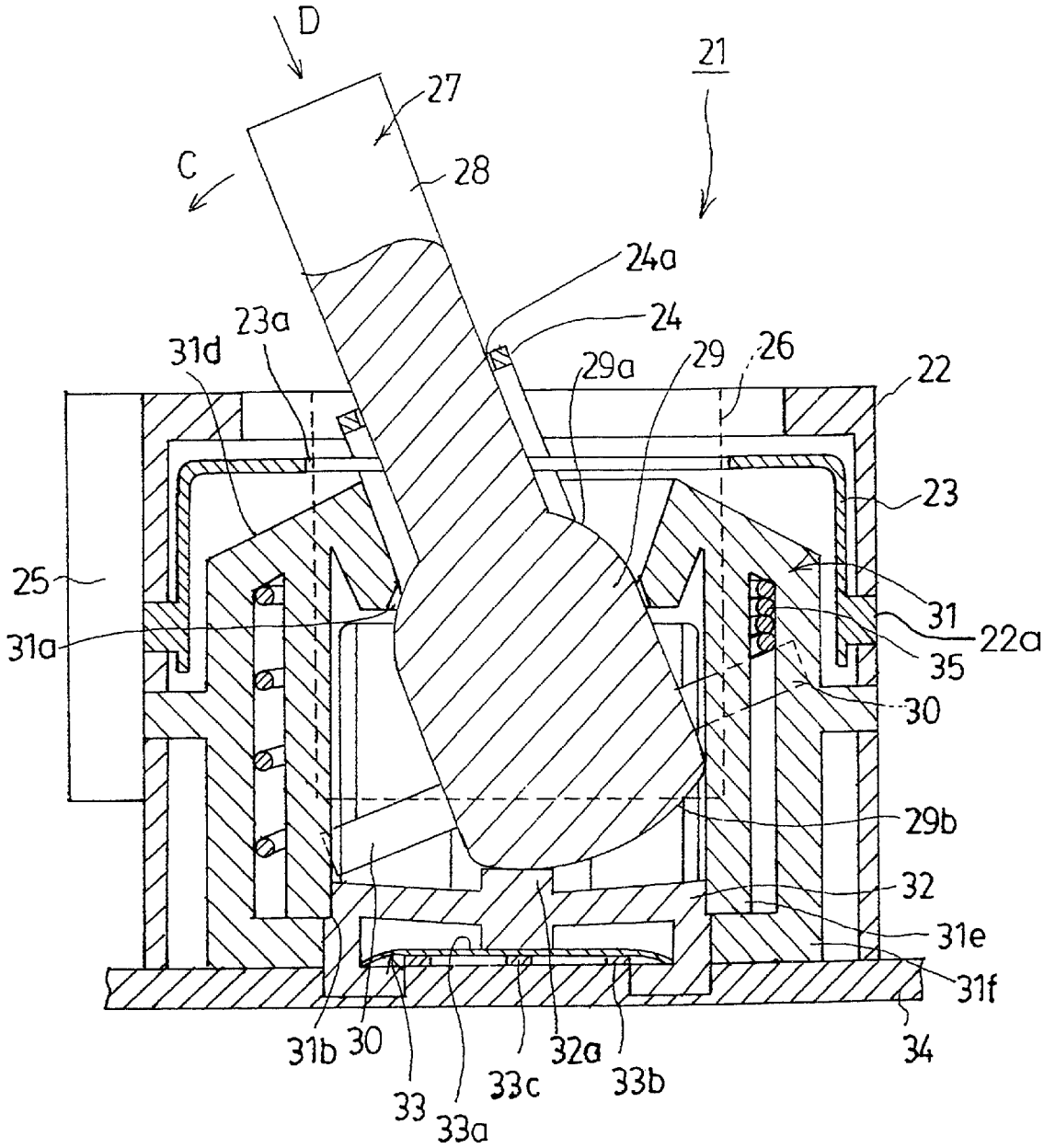
FIG. 3 is a partly cut-away vertical sectional view of the joy stick in a state where the lever is tilted according to the embodiment of the present invention.

When the lever 27 of the joy stick 21 is turned in the direction of an arrow C as shown in FIG. 3, the protrusions 30, 30, - - - of the lever 27 cause the spring 35 to be deformed, the lever 27 sliding in the elongated hole 23*a* formed in the swing arm 23 while receiving the reaction of the spring 35. At the same time, the swing arm 24 turns in the direction of the arrow C to turn the rotary encoder 25 attached to an end of the swing arm 24.

Next, when the lever 27 is no longer depressed in the direction of the arrow C, the lever 27 returns to assume the vertical attitude as shown in FIG. 1 due to the restoring force of the spring 35. When the lever 27 is turned in a direction at right angles with the direction of the arrow (back-and-forth direction in FIG. 1) instead of the direction of the arrow C, the swing arm. 23 rotates to rotate the rotary encoder 25 coupled to the end of the swing arm 23. When no longer depressed, the lever 27 returns to the initial position. The direction of operation of the lever 27 is not limited to the direction of the arrow C or to the direction at right angles with the direction of the arrow C, but can be turned in any direction which is in the horizontal direction in FIG. 1.

The lever 27 that is depressed in the direction of an arrow D causes the flexible member 32 to be deformed, whereby the protruded portion 32*a* provided on the flexible member 32 displaces downward, so that the moving contact member 33*a* and the fixed contact member 33*c* are connected to each other.

Next, when the lever 27 is no longer depressed in the direction of the arrow D, the flexible member 32 and the flexible contact member 33*a* return, and the circuit between the moving contact member 33*a* and the fixed contact member 33*c* is opened. The operation for closing the circuit between the moving contact member 33*a* and the fixed contact member 33*c* by depressing the lever 27 in the direction of the arrow D is not limited to only when the lever 27 is assuming the vertical attitude but can be executed even when the lever 27 is being inclined.

Figure 4:
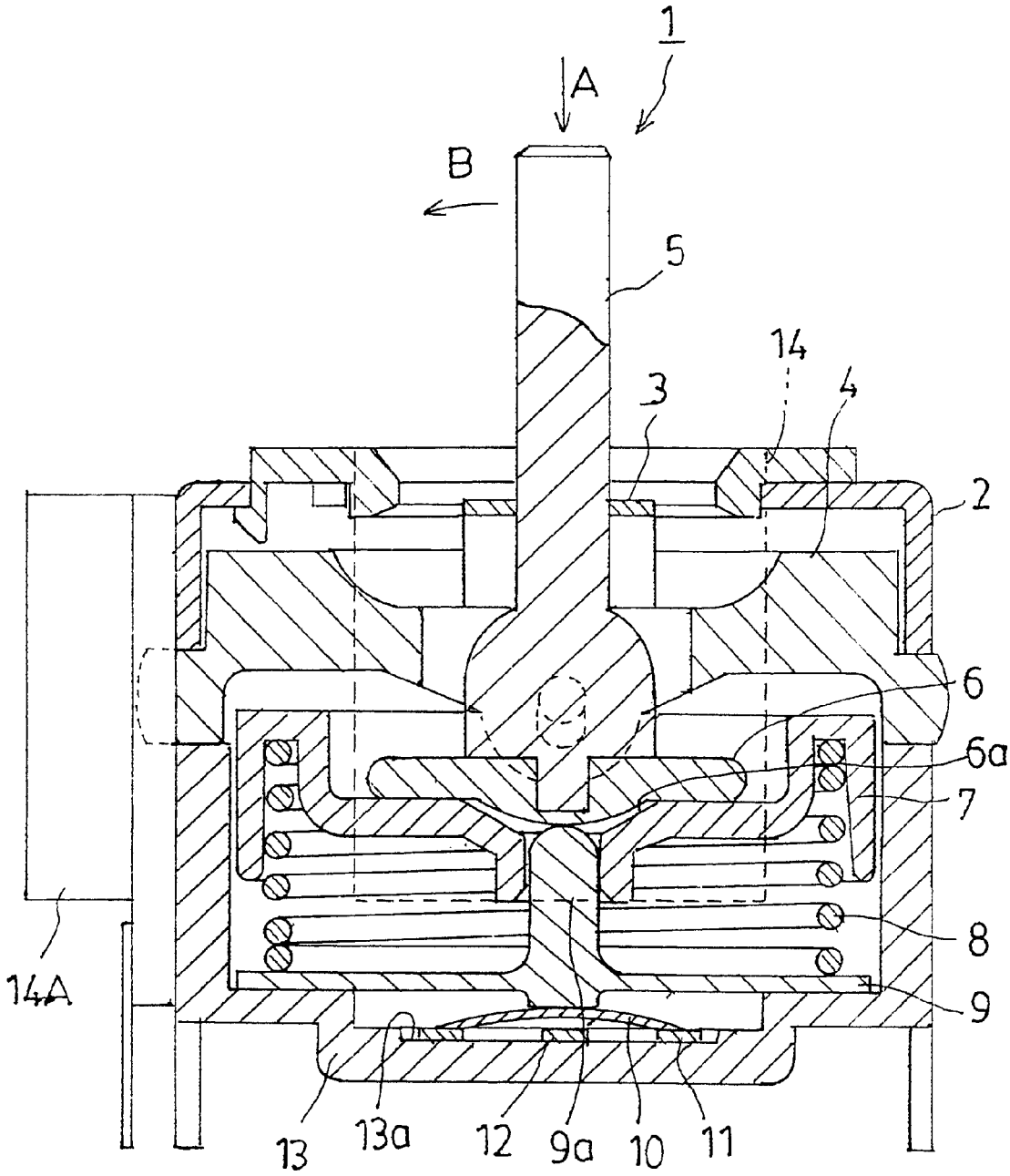
FIG 4 (Prior Art)
FIG. 4 is a partly cut-away vertical sectional view of a conventional joy stick.

Thus, the present invention makes it possible to execute the operation in the same manner as the prior art, and offers the same action and effect as a result of the operation. Here, however, the present invention requires none of the guide member (7 in FIG. 4), swing member (6 in FIG. 4) or bottom plate of the casing (13 in FIG. 4) that are needed in the prior art, and simplifies the constitution.

The present invention can be modified in a variety of other ways without departing from the scope and spirit of the invention, and it should be noted that the invention encompasses even those modified examples, as a matter of course.

According to the embodiment of the present invention as described above in detail, an upper end of a spring is brought into contact with the outer circumference of the lever of the joy stick to maintain the attitude of the lever, a support member is provided for limiting the upward displacement of the lever, plural protrusions are formed near the lower end along the outer circumference of the lever to protrude outward and to support the lower end of the spring, the contact switching means is provided on a base plate, and the base plate is used as the bottom plate of the casing. Therefore, the present invention makes it possible to decrease the number of the parts, requiring none of the guide member, swing plate or bottom plate of the casing that were so far required.

Thus, the present invention decreases the number of parts of the joy stick, simplifies the constitution and decreases the cost of production, which are great effects.

What is claimed is:

1. A joy stick comprising:

a casing;

a lever held in said casing having a longitudinal axis and an upper large diameter portion, a lower curved portion, and protrusions extending from said lever;

a base plate mounted to said casing;

a flexible member on said base plate contacting the lower curved portion biasing said lever upward;

a support member having an inner and outer cylinder and an upper portion with an opening placed within said casing, the upper portion contacting the upper large diameter portion of said lever, the outer cylinder having openings for receiving the protrusions;

a spring placed between the inner and outer cylinder and retained between the upper portion and the protrusions, whereby said spring biases said lever downward towards said flexible support and said flexible support biases said lever upward towards the upper portion of said support member;

a contact switch formed between said base plate and said flexible member; and a rotary encoder coupled to said lever, whereby movement of said lever is detected and said contact switch is capable of being operated by depressing said lever.

2. A joy stick comprising:

a casing;

a lever held in said casing having a longitudinal axis and an upper large diameter portion, a lower curved portion, and protrusions extending from said lever substantially perpendicular to the longitudinal axis;

a base plate mounted to said casing;

a flexible member on said base plate contacting the lower curved portion biasing said lever upward;

a support member having an inner and outer cylinder and an upper portion with an opening placed within said casing, the upper portion contacting the upper large diameter portion of said lever at the opening in said support member, the outer cylinder having openings for receiving the protrusions and permitting said lever and the protrusions to move relative to said support member;

a spring placed between the inner and outer cylinders and retained within the inner and outer cylinders between the upper portion and the protrusions, whereby said spring biases said lever downward towards said flexible support and said flexible support biases said lever upward towards the upper portion of said support member and said support member limits the upward displacement of said lever;

a contact switch formed between said base plate and said flexible member;

two swing arms having elongated holes through which said lever is placed contacting said lever; and a rotary encoder attached to each of said two swing arms, whereby movement of said lever is detected and said contact switch is capable of being operated by depressing said lever.

3. A joy stick as in claim 2 wherein:

said flexible member has an elasticity stronger than that of said spring.

* * * * *